US006042303A

United States Patent [19]

Head

[11] Patent Number: 6,042,303

[45] Date of Patent: Mar. 28, 2000

[54] RISER SYSTEM FOR SUB SEA WELLS AND METHOD OF OPERATION

[76] Inventor: Philip Head, 178 Brent Crescent, Park Royal, London, W10 7XR, United Kingdom

[21] Appl. No.: 08/984,553

[22] Filed: Dec. 3, 1997

[30] Foreign Application Priority Data

Dec. 14, 1996 [GB] United Kingdom ..... 9626021

[51] Int. Cl.[7] ..... E02B 11/38; E02D 23/00; E21B 7/12

[52] U.S. Cl. ..... 405/195.1; 166/359; 166/367; 405/224

[58] Field of Search ..... 166/350, 345, 166/359, 367, 224; 175/7; 405/195.1, 224

[56] References Cited

U.S. PATENT DOCUMENTS

| | | | |
|---|---|---|---|
| 4,182,584 | 1/1980 | Panicker | 405/195 |
| 4,391,332 | 7/1983 | Fayrem | 166/350 |
| 5,007,482 | 4/1991 | Forsyth et al. | 166/345 |

FOREIGN PATENT DOCUMENTS

| | | |
|---|---|---|
| 1 593 014 | 7/1981 | United Kingdom . |
| 2 163 404 | 2/1986 | United Kingdom . |
| 2 274 476 | 7/1994 | United Kingdom . |
| 2297337 | 7/1996 | United Kingdom . |

*Primary Examiner*—Dennis L. Taylor
*Attorney, Agent, or Firm*—Herbert Dubno

[57] ABSTRACT

An offshore oil or gas well riser system which forms a connection between the well head and a surface vessel. The system has a first riser section which extends vertically and is essentially rigid and a second riser section which is made of a flexible material to accommodate movements of the surface vessel. The first riser section has buoyancy means attached to its upper end to support at least partly the weight of the first riser section, and the first and second riser sections have corresponding first and second bores which provide a continuous path between the surface vessel and the well head. The profile of the flexible second riser section is variable to provide a smooth continuous path through its corresponding second bore and such that the path does not extend below the upper end of the first riser section. An emergency disconnect is provided between the first riser section and the second riser section and a full bore valve is provided between the first riser section and the second riser section to permit the passage of tools and equipment down through the riser to provide well intervention or other well operations.

12 Claims, 7 Drawing Sheets

RISER SYSTEM FOR SUB SEA WELLS AND METHOD OF OPERATION

FIELD OF THE INVENTION

My present invention relates to a riser system for accessing and servicing sub sea oil or gas wells. The riser system may be used for production or to access an existing well to carry out intervention operations. Such access is required for a number of reasons including the taking of further measurements of the reservoir by introducing logging devices, for servicing or installation of electric submersible pumps to enhance production rates for, replacing down-hole safety valves, for cleaning-out debris, for zonal isolation re-perforating or for many other reasons.

BACKGROUND OF THE INVENTION

Typically for a sub sea production well the original drilling platform will have been removed and the well head will have to be accessed by means of a suitable surface vessel. In order that the required operations can be carried out to the well it is necessary that the movement of the vessel which is floating on the surface of the sea is compensated for to ensure positional consistency with respect to the well itself which is fixed on the sea bed. This is conventionally provided by means of a heave compensation system on the vessel itself which is extremely cumbersome and expensive.

GB-A-2297337 is an example of a riser system which overcomes this problem and provides compensation for the heave and swell of the sea by a continuous coiled tubing riser which extends from the surface vessel to the well and which adopts a controlled 'S' profile which itself accommodates the movements of the surface vessel without them affecting the lower regions of the riser at the well head end. This disadvantage of this system is that the whole riser has to be made out of special grade materials in order to be sufficiently flexible and this is expensive in particular for wells which are located on a sea bed more than several hundred or several thousand feet below the sea level.

Other existing systems involve fixed or semi-fixed platforms which are expensive to install and maintain.

OBJECTS OF THE INVENTION

It is an object of the invention to provide a method and apparatus which can provide positional consistency between the well head and the vessel without the need for an expensive heave compensation system on the vessel. The apparatus and method should also be capable of insuring that there is no damage caused to the well head by bending moments applied by movement of the piping connecting it to the surface vessel.

It is also an object of the invention to provide a riser system which can be rapidly deployed to provide a conduit between the well head and a floating vessel.

SUMMARY OF THE INVENTION

An offshore oil or gas well riser system which forms a connection between the well head and a surface vessel, the riser system comprising a first riser section which extends vertically and is essentially rigid and a second riser section which is made of a flexible material to accommodate movements of the surface vessel, relative to the well head and fixed lower riser section, wherein the first riser section comprises buoyancy means attached to its upper end to support at least partly the weight of the first riser section. According to the invention the first and second riser sections comprise corresponding first and second bores which provide a continuous path between the surface vessel and the well head and the profile of the flexible second riser section is variable to provide a smooth continuous path through its corresponding second bore and such that the path does not extend below the upper end of the first riser section.

Preferably emergency disconnect means are provided between the lower riser section and the upper flexible section.

The support buoys are preferably connected by air line tubes which enable air to be removed from and added to the support buoys to adjust the amount of buoyancy they provide.

The lower riser will preferably be a coiled tubing riser which is lowered down from a coiled tubing reel.

The upper flexible section of the riser extends for a depth which is sufficient to accommodate the expected heave on the surface vessel. This will vary according to the sea or ocean conditions but is preferably between 100 and 400 feet.

The lower section preferably has a control valve at its upper end which may be closed when it is required to access the inside of the riser at the surface vessel. Such access will be required to lower different tools and instruments into the well and the upper end of the riser needs to opened for this purpose which exposes the well fluids to the surface vessel. Because this is potentially dangerous the well fluids are isolated by closing the control valve. The well fluids in the riser above the control valve can either be bled away after the valve has been closed or alternatively pressed back down the riser by an inert fluid before the control valve is closed. Preferably the control valve is a double ball valve.

Preferably the power and signal cables which are connected between the surface vessel and the well head are arranged around the outside of the riser. The cable is preferably wound around the riser in the form of a helix which serves to act as a vortex shredder which ameliorates the effects of ocean currents. Rather than being continuously wound round the coiled tubing in the sane direction the cable may be wound a complete turn of nearly a complete turn in one direction and then wound back in the opposite direction. In this way essentially the same spiralling effect is achieved but it is easily to carry out using automatic spiralling equipment which does not need to be designed to undergo numerous complete turns.

The position of the vessel may be adjusted so that a smooth continuous and sufficiently shallow curve is provided in the flexible upper section of the riser permitting equipment to be transmitted inside between the surface vessel and the well.

There is also provided by the invention a method of installation of the well riser system which comprises the following steps.

a. lowering a first lower riser section towards the well head, b. connecting the first lower riser to a support line at its upper end and lowering it further to the well head and connecting it thereto preferably with the assistance of a remote vehicle and guide lines, c. connecting the second flexible upper riser section to the upper end of the first lower riser section to form a continuous riser, d. moving the vessel off-line with the well so that the flexible upper riser section forms an 'S' profile to accommodate the rise and fall of the vessel, and e. adjusting buoyancy of support buoys attached to the upper end of the first lower riser section to support is weight.

BRIEF DESCRIPTION OF THE DRAWING

There is now described a detailed embodiment of the invention, in which the well riser system is shown being used for well intervention and the tubing is shown by way of example only as coiled tubing, with reference to the accompanying drawing in which.

SPECIFIC DESCRIPTION

Figure 1:
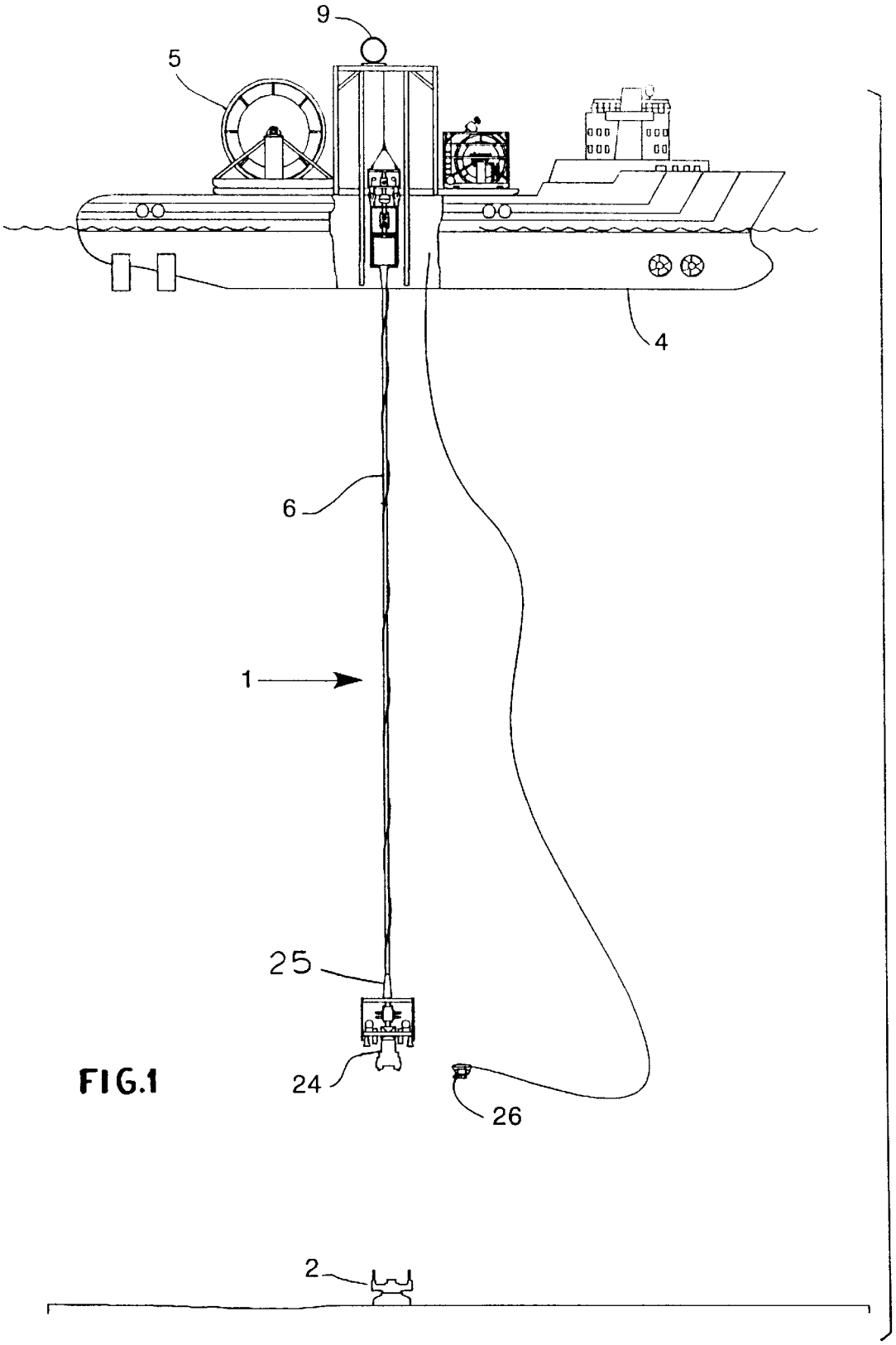
FIG. 1 is an elevational view of a riser system of the invention, showing a first stage of the installation.
Figure 2:
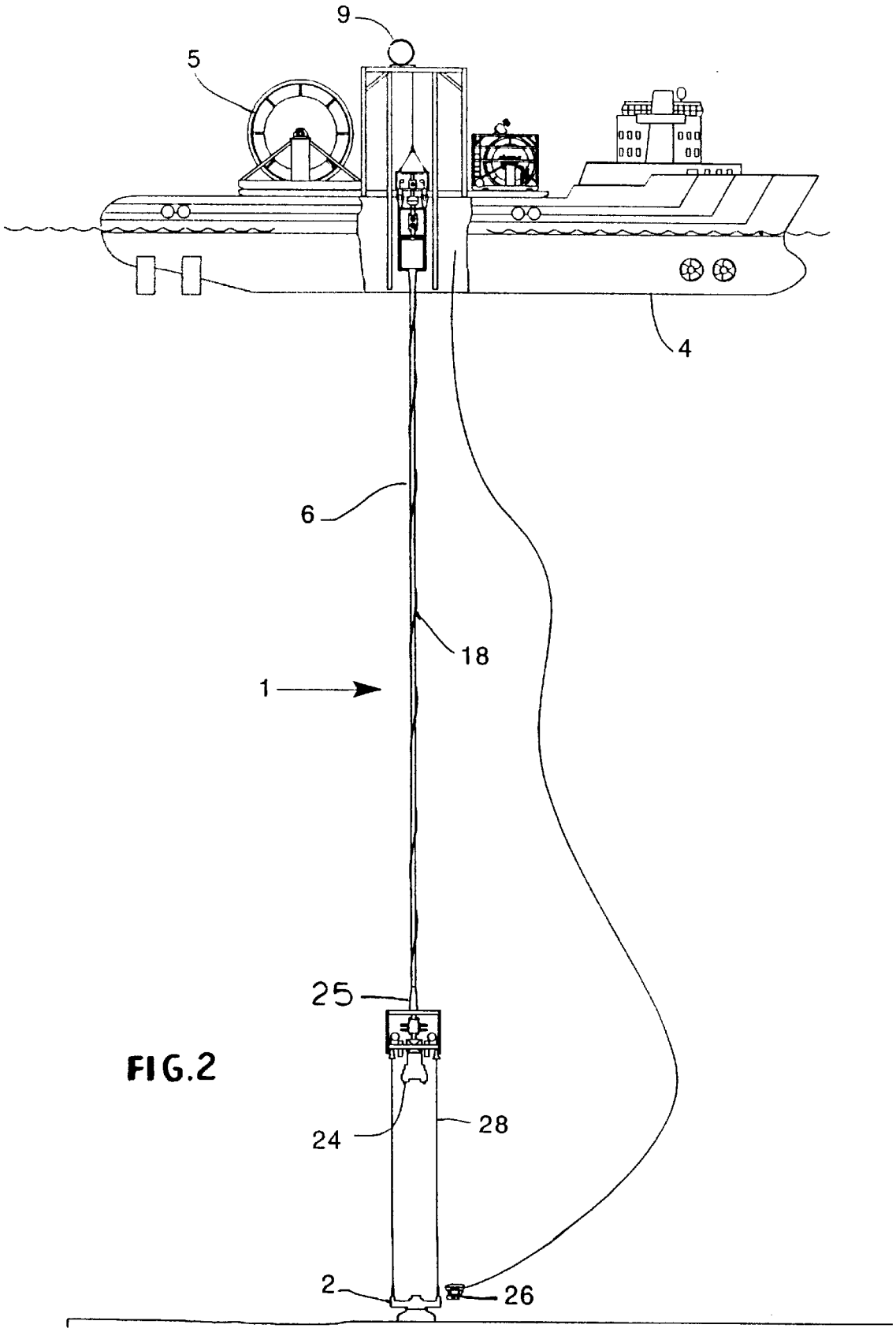
FIG. 2 is an elevational view of a riser system of the invention, showing a second stage of the installation.
Figure 3:
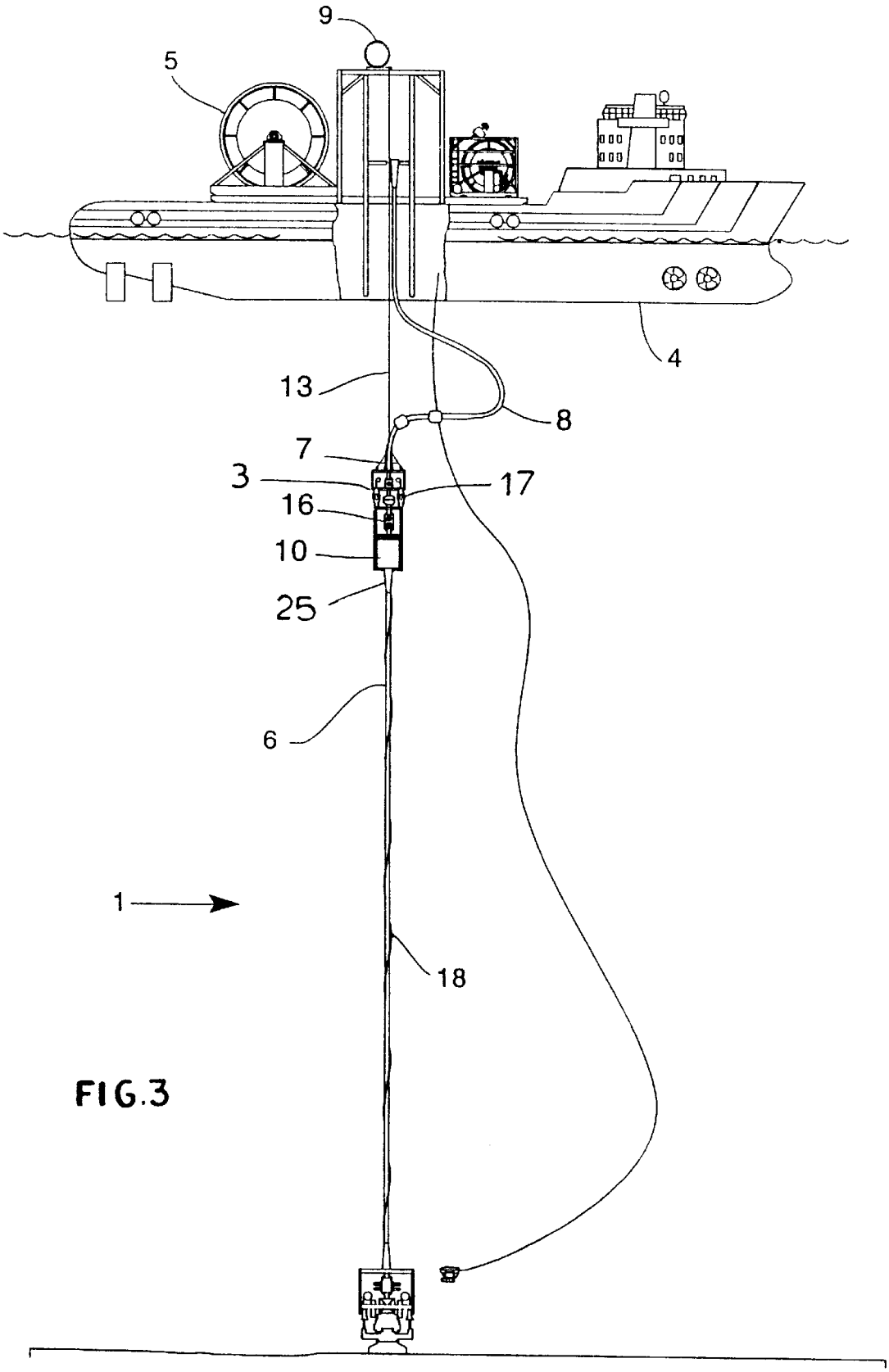
FIG. 3 is an elevation of a riser system of the invention, showing a third stage of the installation.
Figure 4:
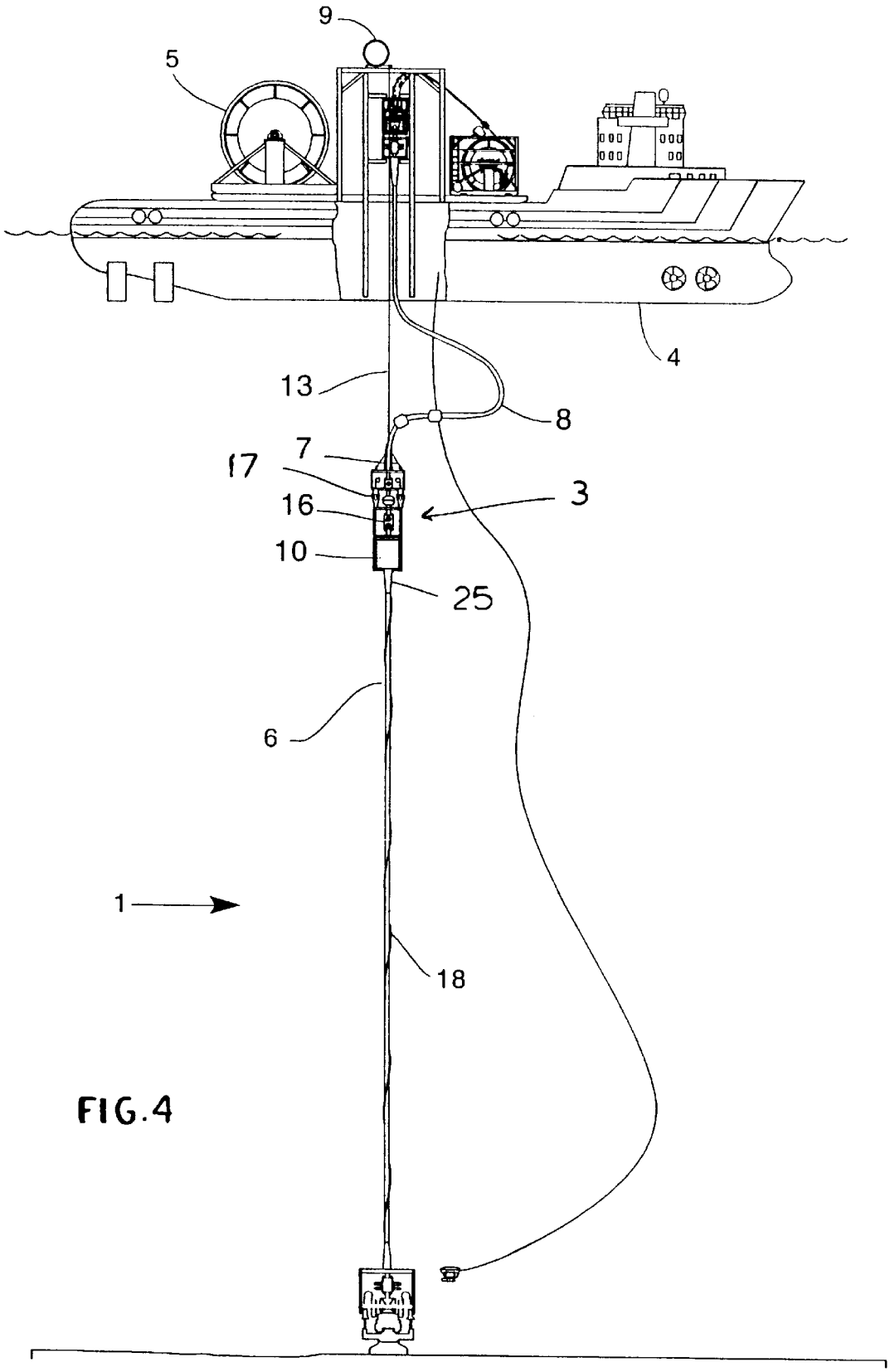
FIG. 4 is an elevational view of a riser system of the invention, showing a fourth stage of the installation.

Referring to FIGS. 1 to 7 show there is shown an offshore oil or gas well riser system 1 which forms a connection between the well head 2 and a surface vessel 4. The riser system 1 comprises a first lower riser section 6 which extends vertically and is essentially rigid and a second upper riser section 8 (FIG. 3) which is made of a flexible material to accommodate movements in the surface vessel 4. At present the properties of commercial grades of steel coiled tubing used have not be researched thoroughly enough for the fatigue properties to be predictable enough for this application, but it is conceivable that steel or other metallic coiled tubing could be used for the flexible section.

The main portion of the riser will be composed of coiled tubing, although it is also proposed to use a section of flexible armored material for the riser section near the surface which will be most subject to the extreme effects of the weather.

A buoyancy module 3 is arranged between the upper flexible riser section 8 and the lower riser section 6 and is fixed to the lower riser section 6.

The surface vessel is intended to be any conveniently available vessel having dynamic positioning, such as a diving support vessel.

A Remotely operated vehicle (ROV) is used to carry out the required sub-sea manipulation tasks.

The lower riser section 6 is connected to the buoyancy means 10 of the buoyancy unit 3 in order to support the weight of the lower section 6. These are shown in the form of a central support buoy 10 which is attached to the buoyancy module 3 arranged at the upper end of the lower riser section 6. The support buoy 10 is connected to air line tubes (not shown) which enable air to be removed from and added to the support buoy 10 to adjust the amount of buoyancy they provide. The buoyancy means which may be evacuated to an extent which provides an upward force on the lower riser section 6 to apply an upward tensile force to the well head 2. A lower riser package 24 is arranged at the lower end of the lower riser section 6. The lower riser package 24 comprises a tree blow out preventer (BOP) which is preferably a dual ram BOP which will be primarily used in the event of an emergency disconnect. The BOP will be capable of cutting the coiled tubing and retaining the pressure in the well thereby preventing any hydrocarbon release. If required, the ram will also be capable of holding the coiled tubing to prevent it from falling down the well. The dual ram will provide two barriers which is the conventional minimum requirement for intervention operations. A tree connector connects the existing Christmas tree of the existing well head 2 to the lower riser 6. Installation winches are also provided which are used to latch the lower riser package 24 to the Christmas tree at the tree connector.

The lower riser section 6 shown is a coiled tubing riser and constitutes the main section of the riser and is essentially an extension of the well tubing. It extends from the top of the lower riser package 24 to the buoyancy module 3. The buoyancy module is adjusted to hold the lower riser section 6 essentially vertical in tension with an acceptable offset dependent upon the environmental conditions and the length of the section 6.

Preferably bend stiffeners 25 are provided at the top and bottom of the lower riser section 6 to provide a and additional resistant to rupture through excessive bending at the point of connection of the riser to the block components. The bend stiffeners are preferably spoolable so that they may be pre-fitted to the coiled tubing of the riser on a reel ready for deployment.

A control umbilical line 18 is attached to the lower riser section and extends the complete length of the riser section. It provides control functions for the Christmas tree and lower riser package 24. Preferably it is spooled from a separate storage 25 drum on the vessel 4. In order to prevent vortex shedding the umbilical is preferably spirally wound around the coiled tubing riser. This avoids the use of specific anti-shedding devices which reduces the overall costs. The cables 18, shown as a single cable 18 bungled together are provided in a protective sheathing. It will be appreciated that it could also be possible to provide the cable inside the riser and this may be preferable in certain circumstances.

The lower riser section 6 is shown as a coiled tubing riser which is lowered down from a coiled tubing reel. It will be appreciated however that for the purposes of the invention the lower riser section could be provided by joined tubing.

The buoyancy module 3 houses a buoyancy tank 10 which may be purged or flooded depending on the operational requirements. Once installed the buoyancy tank 10 is used to maintain the lower riser section 6 in the vertical position and during installation and retrieval the buoyancy is varied to permit latching and unlatching of the lower riser package. The buoyancy of the buoyancy module 3 can also be enhanced by fixed buoyancy elements, such as waterproofed foam buoy elements. Thus the buoyancy module comprises a fixed buoyancy component and a variable buoyancy component.

The sub sea valve assembly 16 may also be located in the buoyancy module 3. In this embodiment this is shown as a double block valve assembly 16 and is primarily required to isolate the flexible riser from the coiled tubing riser. This permits the deployment of tool strings into the flexible riser without the need to depressurise the coiled tubing riser 6. The valve assembly 16 also serves to seal the contents in the event of an emergency and will be able to shear through anything inside the riser in the event of an emergency.

Emergency disconnect means 17 are provided to enables disconnection from the lower riser section 6 in the event of an emergency. The disconnect operation would be sequenced with well pressure control devices to ensure that the well is made safe before the disconnect activates. The emergency disconnect 17 is also arranged, suitable for subsequent reconnection for further use. Pull-in winches are provided on the buoyancy module 3 to enable re-latching after an emergency disconnect.

Figure 6:
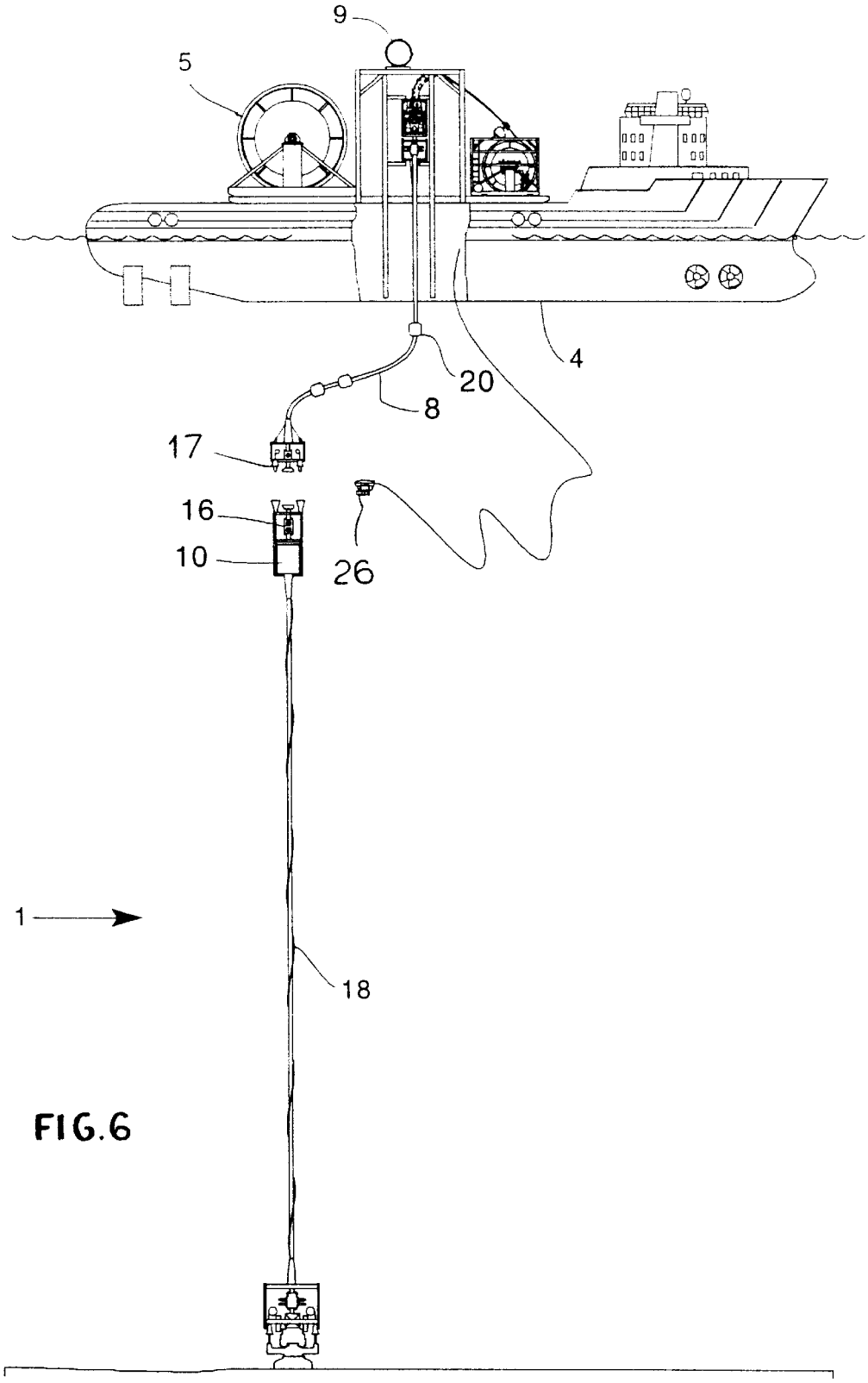
FIG. 6 is an elevational view of a riser system of the invention showing an emergency disconnect feature and FIG. 7 is an elevational view of a riser system of the invention showing reconnection of the system.
Figure 7:
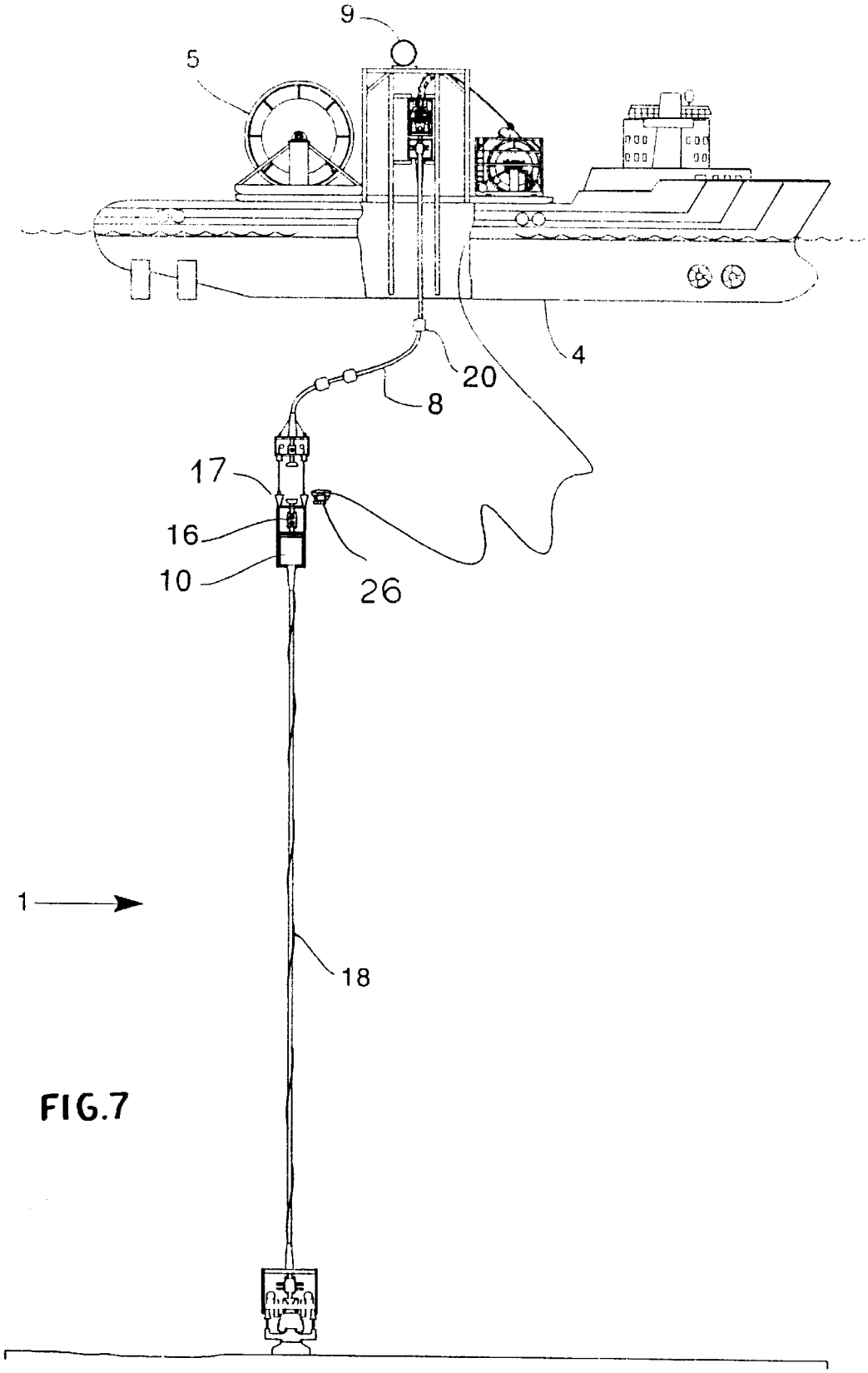

FIG. 6 shows the riser system after an emergency disconnection, and FIG. 7 shows the emergency disconnect 17 being reconnected with the assistance of a remote vehicle 26.

The upper flexible section 8 of the riser system 1 extends between the buoyancy module 3 and the vessel 4 for a depth which is sufficient to accommodate the expected heave on the surface vessel 4 and is connected to the buoyancy module 3 at its lower end 7. This will vary according to the sea or ocean conditions but is preferably between 100 and 400 feet. This can be adjusted by the operation according to the prevailing conditions in the particular location in which the vessel is operating. Conveniently, this decision will be made before the vessel leaves shore and the required length of flexible tubing for the upper section and rigid tubing for the lower section calculated according to the expected conditions at the location of the well can be stowed on the vessel.

The control valve 16 is closed when it is required to access the inside of the riser at the surface vessel 4. Such access will be required to lower different tools and instruments into the well and the upper end of the riser needs to opened for this purpose which exposes the well fluids to the surface vessel 4. Because this is potentially dangerous the well fluids are isolated by closing the control valve 16. The well fluids in the riser section above the control valve, in the upper flexible riser section 8 can either be bled away after the valve 16 has been closed or alternatively pressed back down into the lower rigid riser 6 by an inert fluid under pressure before the control valve 16 is closed.

The position of the surface vessel 4 may be adjusted so that a smooth continuous and sufficiently shallow curve is provided in the flexible upper section of the riser permitting equipment to be transmitted inside between the surface vessel 4 and the well 2.

Figure 5:
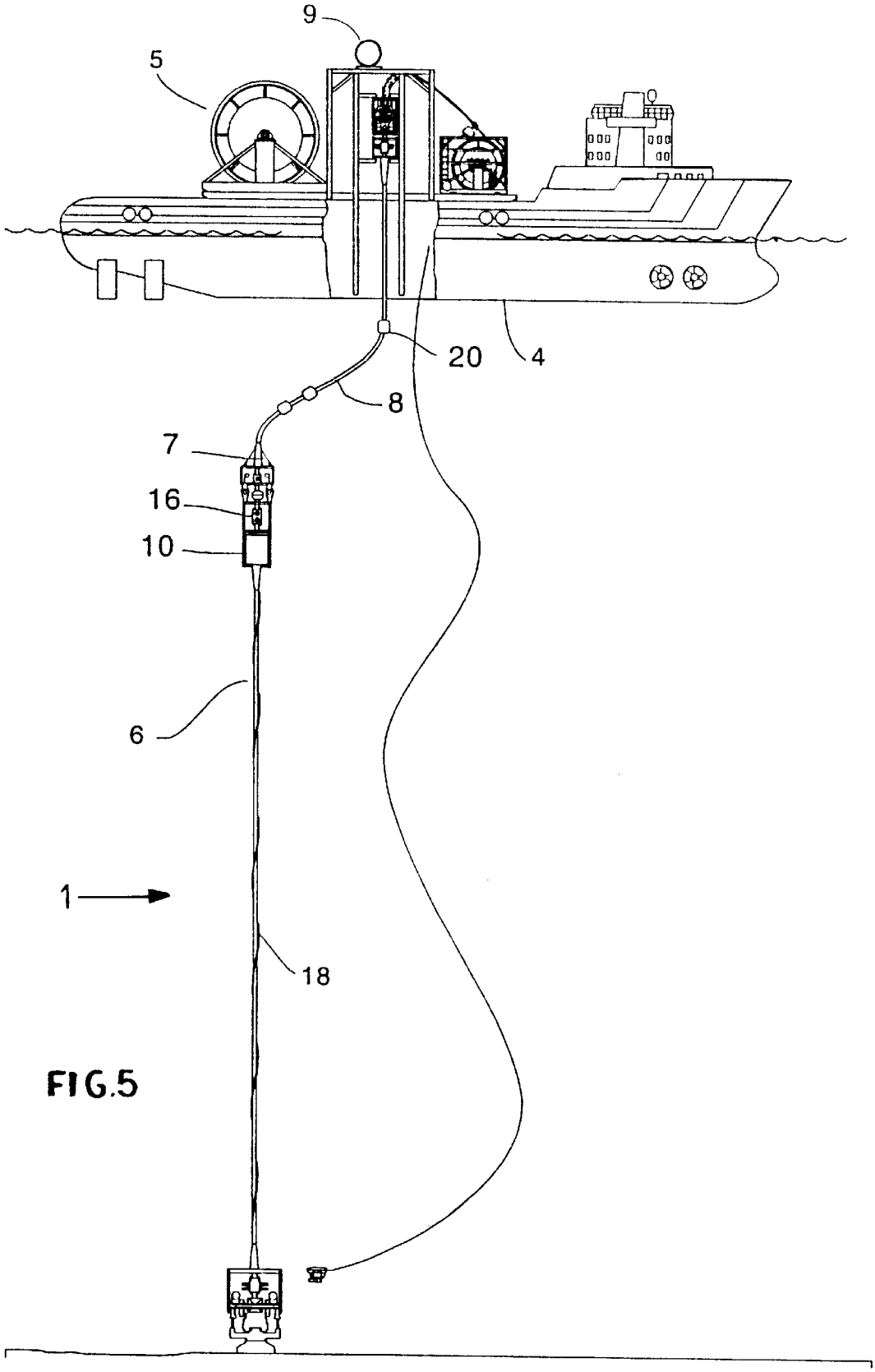
FIG. 5 is an elevational view of a riser system of the invention during use.

Referring to FIG. 5 a weight 20 is attached to the upper region of the upper flexible riser section 8 to provide a straightening effect a first section of the upper riser 8 to ensure that it extends vertically immediately after exiting the vessel so that it does not interfere with the sides of the vessel or other equipment in the vicinity of the exit.

The upper flexible section 8 is preferably made from a flexible hose type material and is preferably a fiber reinforced polymeric material. Such hoses can be made to provide the desired properties of resistance to pressure and temperature and of course are sufficiently flexible to accommodate the desired heaving of the surface vessel. Although such high specification hosing is expensive it is only necessary to have a sufficient length to accommodate the heave and to be clear of the wave formation which is occurring at the surface of the sea or ocean. Usually such wave activity only has an effect for between 100 and 200 feet below the surface when conditions are at their worst. The precise length of flexible upper riser section can be chosen to suit the conditions but it will nearly always be a relatively small length of hose compared to the overall length of the riser system and therefore the overall cost of the riser system will not be prohibitively large. By contrast, because the invention avoids the requirement of a surface heave compensation system the costs savings of the system are considerable.

Referring now to FIGS. 1 to 7 in sequence the method of installation of the well riser system 1 can be followed.

Firstly the vessel is positioned in the desired location with respect to the well head in clear water.

The lower riser package 24 is positioned in the vessel ready for lowering, for example though a moon pool and is connected to the free end of the lower riser section which at this stage is stowed on a spool 5. The spool 5 comprising the lower riser section 6 is slid into position on the vessel and the lower riser section 6 is lowered into the water and towards the well head 2.

When this is complete the upper end of the lower riser section is released from the spool 5 and hung off at the exit of the vessel such as a moon pool. The buoyancy module 3 is then connected to the top of the lower riser section 6 and is connected to a support line 13 at its upper end. The bottom end of the upper flexible riser 8 is then connected to the top of the buoyancy module 3 and the flexible riser 8 and the support line 13 are unreeled from a reel 9 and lowered towards the well head and the weight of the entire payload is taken by the support line 13 so that the flexible riser section 8 is not damaged.

The lower end of the lower riser section 6 and the lower riser package 24 is connected to the well head 2 preferably with the assistance of a remote vehicle 26 and guide lines 28 and corresponding guide posts on the well head 2. Using the pulling winches the lower riser package is latched onto the Christmas tree of the well head 2. The buyancy tanks 10 of the buoyancy module are then evacuated to provide the desired buoyancy to give the desired tension in the lower riser section.

The vessel 4 is then moved off-line with the well 2 so that the flexible upper riser section 8 forms an 'S' profile to accommodate the rise and fall of the vessel 4. The control line 13 is simultaneously paid out or disconnected and winched back on board the vessel.

The function and pressure test procedure is then carried out before proceeding with the well intervention operations.

An injector can be used to inject a further coiled tubing of narrower diameter than the internal diameter of the riser to carry out intervention operations.

It will be appreciated that the riser system according to the invention could be used as an intervention riser to carry out intervention operations in the well by introducing tools and instruments down the centre of the riser preferably by means of a narrowing diameter coiled tubing arranged within the riser but also by means of conventional. It will also be appreciated that the riser system of the present invention can be used as a production riser, as well as for drilling operations.

What is claimed is:

1. An offshore well riser system which forms a connection between a well head and a surface vessel, the riser system comprising:

a first riser section which extends vertically and is essentially rigid;

a second riser section which is made of a flexible material to accommodate movements of the surface vessel, relative to the well head buoyancy means attached to an upper end of said first riser section to support at least partly the weight of the first riser section said, the first and second riser sections comprising corresponding first and second bores which provide a continuous path between the surface vessel and the well head, a profile of the second riser section made of said flexible material being variable to provide a smooth continuous path through said corresponding second bore of said second riser section and such that the path does not extend below the upper end of the first riser section.

2. The riser system according to claim 1 wherein emergency disconnect means are provided between the first riser section and the second riser section.

3. The riser system according to claim 1 wherein at least one full bore valve is provided between the first riser section and the second riser section.

4. The riser system according to claim 1 wherein at least part of the buoyancy means is connected to an air line which enables air to be removed from and added to the buoyancy means to adjust the amount of buoyancy provided thereby.

5. The riser system according to claim 1 wherein said first riser is a coiled tubing riser which is lowered down from a coiled tubing reel.

6. The riser system according to claim 1 wherein the second flexible section of the riser extends for a depth which is sufficient to accommodate expected heave on the surface vessel.

7. The riser system according to claim 1 wherein said first riser is a joined-tubing riser.

8. The riser system according to claim 3 wherein the full bore valve is a double block valve assembly.

9. The riser system according to claim 1 wherein power and signal cables which are connected between the surface vessel and the wellhead are arranged around the outside of the riser.

10. The riser system according to claim 9 wherein the cables are attached around the riser in the form of a helix which serves to act as a vortex shedder.

11. A method of installing a riser system for connecting a well head to a surface vessel, comprising the steps of:

(a) lowering a first lower riser section towards the well head;

(b) connecting the first riser section to a support line at an upper end of said first lower riser system and to a second upper flexible riser section and lowering it further to the well head and connecting it thereto with the assistance of a remote vehicle and guide lines;

(c) inducing tension in the first lower riser section by means of buoyancy means connected to said first lower riser section; and (d) moving the vessel off-line with the well so that the second upper flexible riser section forms a flexible path with an 'S' profile, to accommodate the rise and fall of the vessel.

12. The method according to claim 11 wherein emergency disconnect means are attached to an upper end of the first riser section and to a lower end of the second flexible riser section.

* * * * *